US011173932B2

(12) United States Patent
Nishimura et al.

(10) Patent No.: US 11,173,932 B2
(45) Date of Patent: Nov. 16, 2021

(54) MONITORING SYSTEM FOR RAILWAY VEHICLE

(71) Applicant: Central Japan Railway Company, Nagoya (JP)

(72) Inventors: Kazuhiko Nishimura, Nagoya (JP); Shigemitsu Kita, Nagoya (JP); Gakuji Kobayashi, Nagoya (JP); Suetaka Ebina, Nagoya (JP)

(73) Assignee: CENTRAL JAPAN RAILWAY COMPANY, Nagoya (JP)

( * ) Notice: Subject to any disclaimer, the term of this patent is extended or adjusted under 35 U.S.C. 154(b) by 350 days.

(21) Appl. No.: 16/291,544

(22) Filed: Mar. 4, 2019

(65) Prior Publication Data

US 2019/0270464 A1 Sep. 5, 2019

(30) Foreign Application Priority Data

| | | |
|---|---|---|
| Mar. 5, 2018 | (JP) | JP2018-038811 |
| Sep. 5, 2018 | (JP) | JP2018-165912 |
| Jan. 15, 2019 | (JP) | JP2019-004498 |

(51) Int. Cl.
*B61L 15/00* (2006.01)
*B61F 5/36* (2006.01)

(52) U.S. Cl.
CPC ..... *B61L 15/0081* (2013.01); *B61F 5/36* (2013.01)

(58) Field of Classification Search
CPC ..... B61F 5/10; B61F 5/36; B61F 5/38; B61L 15/0081
See application file for complete search history.

(56) References Cited

FOREIGN PATENT DOCUMENTS

| | | | | |
|---|---|---|---|---|
| JP | 2016159643 | * | 9/2016 | ..... B60G 17/018 |
| JP | 2016159643 A | | 9/2016 | |
| JP | 2017071247 A | | 4/2017 | |

OTHER PUBLICATIONS

Notice of Reasons for Refusal dated Aug. 3, 2021 in corresponding Japanese Patent Applciation No. 2019-004498.
Machine translation of the Notice of Reasons for Refusal dated Aug. 3, 2021 in corresponding Japanese Patent Applciation No. 2019-004498.

* cited by examiner

*Primary Examiner* — Robert J McCarry, Jr.
(74) *Attorney, Agent, or Firm* — David D. Brush; Westman, Champlin & Koehler, P.A.

(57) ABSTRACT

Provided is a monitoring system that can find abnormality in a device that supports a vehicle body of a railway vehicle during running at an early stage. The monitoring system for the railway vehicle includes a detector and a determiner. The detector detects a pressure A1 of a first air spring, a pressure A2 of a second air spring, a pressure A3 of a third air spring, and a pressure A4 of a fourth air spring of the railway vehicle during running. The first, second, third, and fourth air springs are respectively disposed on right front, left front, right rear, and left rear sides in a running direction of the railway vehicle. The determiner determines abnormality from a relation between a magnitude of diagonal imbalance P obtained from a formula (1) or (2) below and a mileage or elapsed time of the railway vehicle.

$$P=(A1-A2)-(A3-A4) \quad (1)$$

$$P=(A3-A4)-(A1-A2) \quad (2)$$

12 Claims, 4 Drawing Sheets

MONITORING SYSTEM FOR RAILWAY VEHICLE

CROSS-REFERENCE TO RELATED APPLICATIONS

The present application claims the benefit of Japanese Patent Application No. 2018-38811 filed on Mar. 5, 2018, No. 2018-165912 filed on Sep. 5, 2018, and No. 2019-4498 filed on Jan. 15, 2019 with the Japan Patent Office, the entire disclosures of which are incorporated herein by reference.

BACKGROUND

The present disclosure relates to a monitoring system for a railway vehicle.

A railroad truck of the railway vehicle is a crucial component that affects vehicle running safety, vehicle running stability, ride comfort, and the like of the railway vehicle. Therefore, the railroad truck is periodically inspected visually or in a non-destructive manner (for example, a magnetic particle flaw inspection or the like) to identify a defect.

Since it is unable to perform the aforementioned inspection during commercial operation, defects cannot be found during a periodical inspection. Thus, a method has been proposed in which gas is sealed inside the railroad truck and a pressure is detected, so as to detect abnormality in a railroad truck during running. However, this method requires change in structure of the railroad truck, which causes an increase in cost.

On the other hand, another method has been proposed in which pressures of air springs disposed between a railroad truck and a vehicle body are detected, so as to detect abnormality by imbalance of the pressures (see Japanese Unexamined Patent Application Publication No. 2016-159643).

SUMMARY

In the method of the aforementioned publication, it is determined that abnormality has occurred when a state in which an imbalance value exceeds a threshold value continues for a given length of time. In the aforementioned method, the given length of time is set to be relatively short, that is, around 10 seconds. In order to avoid erroneous determination, it is necessary to increase the threshold value of the imbalance value. Therefore, a large abnormality or an acute abnormality is detected in the aforementioned method, and a chronic progressive abnormality cannot be detected at an early stage.

In one aspect of the present disclosure, it is desirable that a monitoring system for a railway vehicle is provided which can detect abnormality in a device that supports a vehicle body in a railway vehicle during running at an early stage.

One aspect of the present disclosure is a monitoring system for a railway vehicle that comprises a detector and a determiner. The detector detects a pressure A1 of a first air spring, a pressure A2 of a second air spring, a pressure A3 of a third air spring, and a pressure A4 of a fourth air spring of the railway vehicle during running. The first air spring is disposed on a right front side in a running direction of the railway vehicle between a vehicle body and a railroad truck. The second air spring is disposed on a left front side in the running direction of the railway vehicle between the vehicle body and the railroad truck. The third air spring is disposed on a right rear side in the running direction of the railway vehicle between the vehicle body and the railroad truck. The fourth air spring is disposed on a left rear side in the running direction of the railway vehicle between the vehicle body and the railroad truck. The determiner determines abnormality in a device that supports the vehicle body, based on the pressures detected by the detector.

The determiner determines abnormality from a relation between a magnitude of diagonal imbalance P obtained from a formula (1) or (2) below and a mileage or elapsed time of the railway vehicle.

$$P=(A1-A2)-(A3-A4) \quad (1)$$

$$P=(A3-A4)-(A1-A2) \quad (2)$$

With such a configuration, even if an absolute value of the diagonal imbalance P is small, it is possible to determine that abnormality has occurred, for example, when the value of the diagonal imbalance P is sustained while the railway vehicle is running. Therefore, abnormality that gradually progresses over a long time or a long distance (for example, over a few hours) can be found at an early stage. Also, when the railway vehicle stops for a long time at a point where the absolute value of the diagonal imbalance P increases, erroneous determination that abnormality has occurred can be avoided.

Another aspect of the present disclosure is a monitoring system for a railway vehicle that comprises a detector and a determiner. The detector detects at least two of a pressure A1 of a first air spring, a pressure A2 of a second air spring, a pressure A3 of a third air spring, and a pressure A4 of a fourth air spring of the railway vehicle during running. The first air spring is disposed on a right front side in a running direction of the railway vehicle between a vehicle body and a railroad truck. The second air spring is disposed on a left front side in the running direction of the railway vehicle between the vehicle body and the railroad truck. The third air spring is disposed on a right rear side in the running direction of the railway vehicle between the vehicle body and the railroad truck. The fourth air spring is disposed on a left rear side in the running direction of the railway vehicle between the vehicle body and the railroad truck. The determiner determines abnormality in a device that supports the vehicle body, based on the pressures detected by the detector.

The determiner determines abnormality from a relation between a magnitude of diagonal imbalance P obtained from any one of formulae (3) to (8) below and a mileage or elapsed time of the railway vehicle.

$$P=A1-A2 \quad (3)$$

$$P=A3-A4 \quad (4)$$

$$P=A2+A3 \quad (5)$$

$$P=A1+A4 \quad (6)$$

$$P=A1-A3 \quad (7)$$

$$P=A2-A4 \quad (8)$$

With such a configuration as well, it is possible to determine that abnormality has occurred, for example, when the value of the diagonal imbalance P is sustained while the railway vehicle is running. The value P obtained from any one of the formulae (3) to (8) above is a value that fluctuates (that is, increases or decreases) following change in diagonal imbalance of pressures of the air springs, which value is an index representing diagonal imbalance of pressures of the air springs.

Still another aspect of the present disclosure is a monitoring system for a railway vehicle that comprises a detector and a determiner. The detector detects at least one of a pressure A1 of a first air spring, a pressure A2 of a second air spring, a pressure A3 of a third air spring, and a pressure A4 of a fourth air spring of the railway vehicle during running. The first air spring is disposed on a right front side in a running direction of the railway vehicle between a vehicle body and a railroad truck. The second air spring is disposed on a left front side in the running direction of the railway vehicle between the vehicle body and the railroad truck. The third air spring is disposed on a right rear side in the running direction of the railway vehicle between the vehicle body and the railroad truck. The fourth air spring is disposed on a left rear side in the running direction of the railway vehicle between the vehicle body and the railroad truck. The determiner determines abnormality in a device that supports the vehicle body, based on the pressure detected by the detector.

The determiner determines abnormality from a relation between a magnitude of diagonal imbalance P obtained from any one of formulae (9) to (12) below and a mileage or elapsed time of the railway vehicle.

$$P=A1 \tag{9}$$

$$P=A2 \tag{10}$$

$$P=A3 \tag{11}$$

$$P=A4 \tag{12}$$

With such a configuration as well, it is possible to determine that abnormality has occurred, for example, when the value of the diagonal imbalance P is sustained while the railway vehicle is running. The value P obtained from any one of the formulae (9) to (12) above is a value that fluctuates following change in diagonal imbalance of pressures of the air springs, which value is an index representing diagonal imbalance of pressures of the air springs.

In further aspect of the present disclosure, the determiner may determine that abnormality has occurred when a representative value of the diagonal imbalance P at a certain mileage or elapsed time of the railway vehicle is greater than a positive threshold value or smaller than a negative threshold value. With such a configuration, abnormality in the support device can be easily and reliably detected at an early stage.

In further aspect of the present disclosure, the determiner may determine that abnormality has occurred when an integral value of the diagonal imbalance P at a certain mileage or elapsed time of the railway vehicle is equal to or greater than a certain value. With such a configuration, abnormality in the support device can be determined with higher accuracy.

In still further aspect of the present disclosure, the determiner may determine that abnormality has occurred when a state in which the diagonal imbalance P is greater than a positive threshold value or smaller than a negative threshold value has continued at a certain mileage or elapsed time. With such a configuration as well, abnormality in the support device can be determined with higher accuracy.

BRIEF DESCRIPTION OF THE DRAWINGS

Example embodiments of the present disclosure will be described hereinafter with reference to the accompanying drawings, in which.

DETAILED DESCRIPTION OF THE PREFERRED EMBODIMENTS

1. First Embodiment

[1-1. Configuration]

Figure 1:
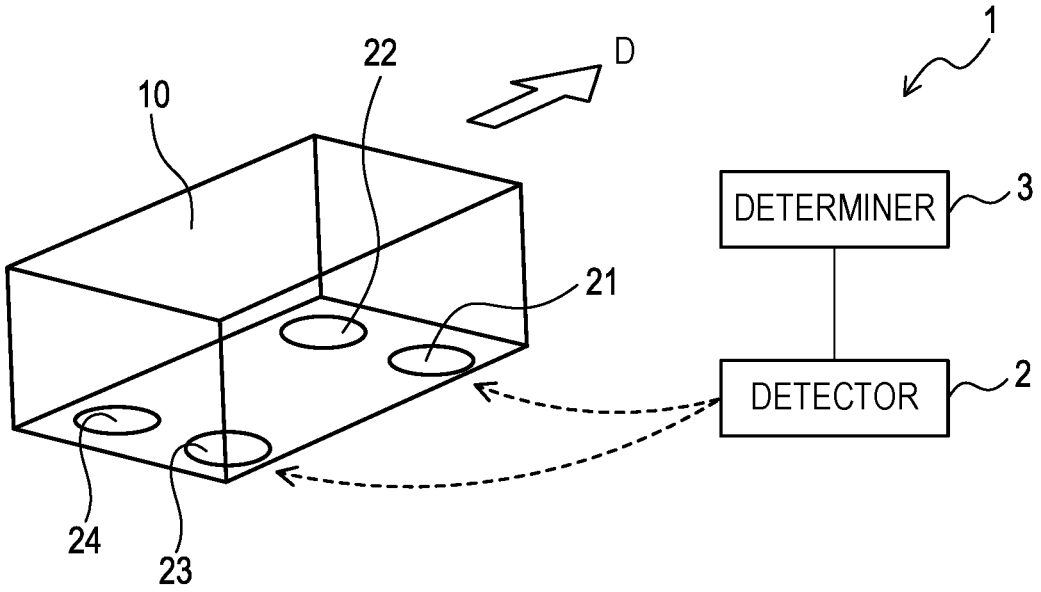
FIG. 1 is a block diagram schematically showing a structure of a monitoring system for a railway vehicle in an embodiment.

A monitoring system 1 for a railway vehicle (hereinafter, simply referred to as a "monitoring system" as well) shown in FIG. 1 is a system to monitor a device that supports a vehicle body 10 of the railway vehicle during running. The monitoring system 1 comprises a detector 2 and a determiner 3.

<Railway Vehicle>

Figure 2:
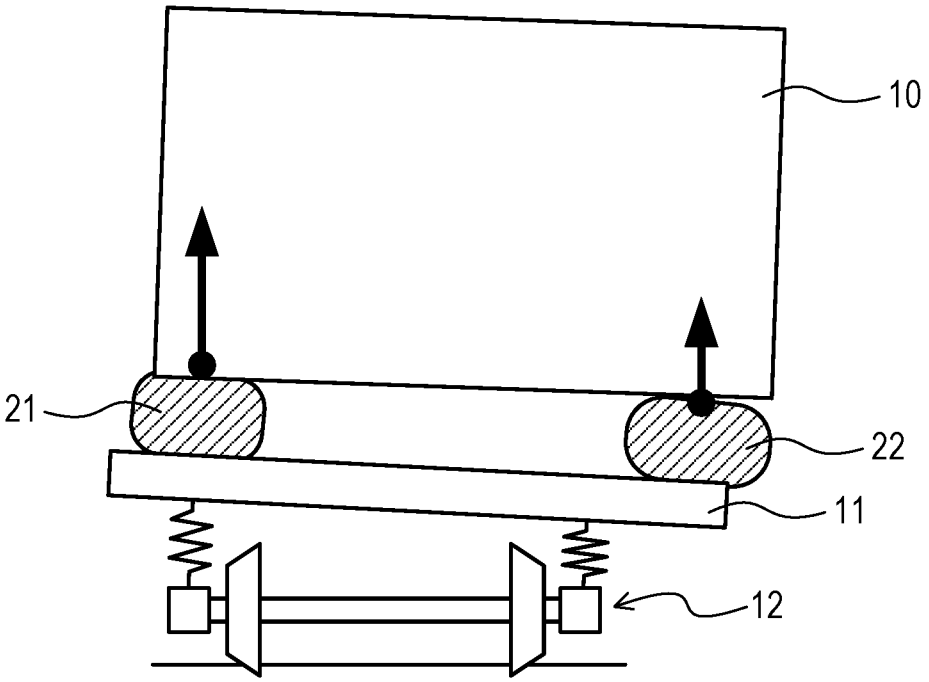
FIG. 2 is a schematic front view of the railway vehicle.

As shown in FIGS. 1 and 2, the railway vehicle monitored by the monitoring system 1 includes a vehicle body 10, a railroad truck 11, a wheelset 12, a first air spring 21, a second air spring 22, a third air spring 23, and a fourth air spring 24.

The first air spring 21, second air spring 22, third air spring 23 and fourth air spring 24 are disposed between the vehicle body 10 and the railroad truck 11. These air springs are expandable and contractible in a vertical direction, and support the vehicle body 10 in the vertical direction on the railroad truck 11.

The first air spring 21 is disposed on a right front side in a running direction D of the railway vehicle. The second air spring 22 is disposed on a left front side in the running direction D. The third air spring 23 is disposed on a right rear side in the running direction D. The fourth air spring 24 is disposed on a left rear side in the running direction D.

The railroad truck 11 includes a truck frame, a vehicle height adjuster, and the like. The first air spring 21, the second air spring 22, the third air spring 23, and the fourth air spring 24 are attached to a top surface of the railroad truck 11. The wheelset 12 is attached to an under surface of the railroad truck 11.

For example, when the truck frame is deformed, difference (that is, imbalance) in pressure between the respective air springs increases, as shown in FIG. 2. The monitoring system 1 detects such abnormality in a vehicle body support device. The vehicle body support device includes the first air spring 21, the second air spring 22, the third air spring 23, and the fourth air spring 24, in addition to the truck frame and the vehicle height adjuster that make up the railroad truck 11.

<Detector>

The detector 2 detects a pressure A1 of the first air spring 21, a pressure A2 of the second air spring 22, a pressure A3 of the third air spring 23, and a pressure A4 of the fourth air spring 24 of the railway vehicle during running. The detector 2 is configured by a known pressure sensor.

<Determiner>

The determiner 3, based on the pressures detected by the detector 2, determines abnormality in the vehicle body support device. The determiner 3, for example, is configured by a computer provided with an input/output portion.

The determiner 3 uses a relation of imbalance in the four air springs to determine abnormality. In other words, the determiner 3 determines abnormality from a relation between a magnitude of diagonal imbalance P obtained from a formula (1) or (2) below and a mileage or elapsed time of the railway vehicle.

$$P=(A1-A2)-(A3-A4) \quad (1)$$

$$P=(A3-A4)-(A1-A2) \quad (2)$$

Figures 3A, 3B, 3C:
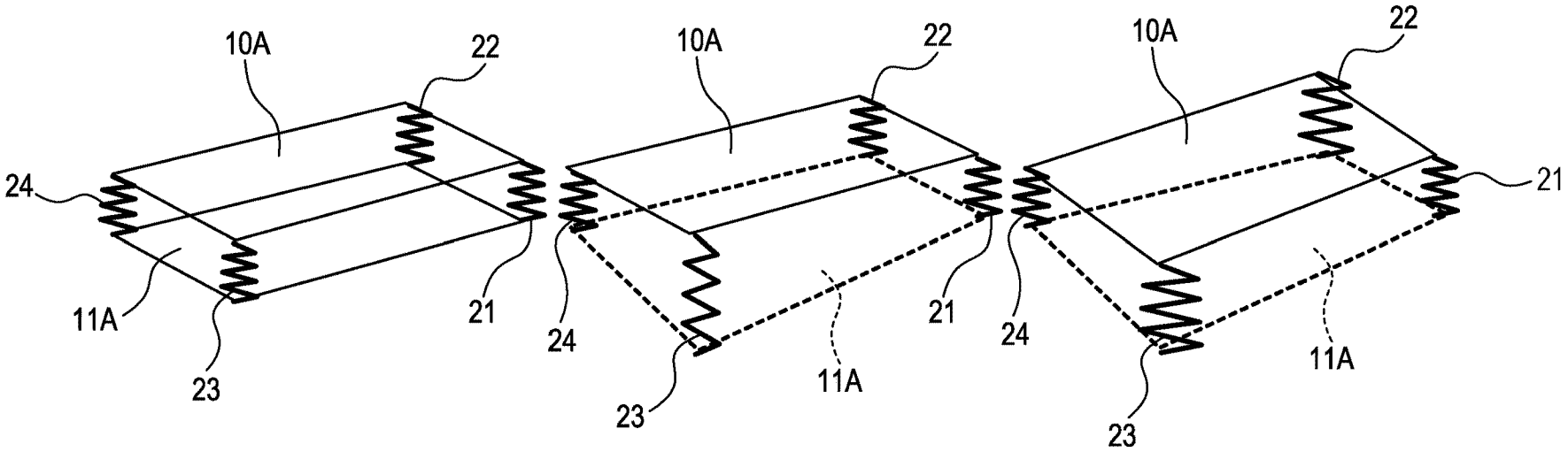
FIG. 3A is a schematic diagram showing a state of four air springs when a railroad truck is in normal state.
FIG. 3B is a schematic diagram showing a state of the four air springs when the railroad truck starts to deform.
FIG. 3C is a schematic diagram showing a state of the four air springs in equilibrium after the railroad truck has deformed.

When there is no abnormality in the vehicle body support device, imbalance in the four air springs interposed between the vehicle body surface 10A and the railroad truck surface 11A is small, as shown in FIG. 3A. On the other hand, for example, when a right rear portion of the truck frame is deformed, the pressure A3 of the third air spring 23 near the deformation decreases first, as shown in FIG. 3B.

Then, when the deformation progresses and comes to an equilibrium state (that is, balanced state), the pressure A2 of the diagonally disposed second air spring 22 changes. As shown in FIG. 3C, the pressure A3 of the third air spring 23 and the pressure A2 of the second air spring 22 are balanced. However, the pressure A2 of the second air spring 22 and the pressure A3 of the third air spring 23 become smaller than the pressure A1 of the first air spring 21 and the pressure A4 of the fourth air spring 24. Therefore, an absolute value of the diagonal imbalance P increases. When the deformation further progresses, an amount of change in air spring pressure increases. Thus, the absolute value of the diagonal imbalance P increases.

The determiner 3 determines that abnormality has occurred when a representative value of the diagonal imbalance P at a certain mileage or elapsed time of the railway vehicle is greater than a positive threshold value or smaller than a negative threshold value. Even when there is no abnormality in the vehicle support device, the diagonal imbalance P increases or decreases at the time of passing through a transition curve or a turnout. However, such increase or decrease of the diagonal imbalance P which is not based on abnormality in the vehicle body support device is recovered at a short distance or time. Therefore, it is possible to accurately determine abnormality by continuously monitoring the diagonal imbalance P based on the mileage or elapsed time.

In determination of abnormality, which of the positive threshold value or the negative threshold value to use is appropriately determined depending on which one of the formulae (1) and (2) to choose as a calculation formula of the diagonal imbalance P. In other words, when a value of the diagonal imbalance P at the time of operation of the railway vehicle exists on the positive side, the positive threshold value is used. When the value of the diagonal imbalance P exists on the negative side, the negative threshold value is used.

Specifically, a low-pass filter of distance or time with respect to the diagonal imbalance P is used to remove values that are not sustained for a certain distance or time of running from among the diagonal imbalance P at each point or time, and the resulting value is set as the "representative value of the diagonal imbalance P at a certain mileage or elapsed time". Or, an average value of the diagonal imbalance P at each point or time at a certain mileage or elapsed time may be the "representative value of the diagonal imbalance P at a certain mileage or elapsed time".

The "representative value of the diagonal imbalance P at a certain mileage or elapsed time" may be acquired using an equipment for acquiring the diagonal imbalance P at one or more specified acquisition points, instead of the low-pass filter. In case of using multiple acquisition points, multiple points having the same line shape (for example, points where running speeds are the same such as a point immediately after departure, a high-speed running point and the like) are set as the acquisition point.

The aforementioned equipment acquires diagonal imbalance, for example, when receiving a pass signal of the acquisition point as an input. The pass signal of the acquisition point may be transmitted to the equipment from a device disposed on the ground side of the acquisition point, or may be directly input to the equipment based on human operation such as depression of a switch, turning on of power or the like.

The determiner 3 monitors change in accordance with the mileage or elapsed time of the representative value of the diagonal imbalance P. The determiner 3 determines that abnormality has occurred in the vehicle body support device when the representative value of the diagonal imbalance P is greater than the specified positive threshold value or smaller than the specified negative threshold value.

The railway vehicle has a unique initial value of the diagonal imbalance P, depending on conditions such as device arrangement. Therefore, use of the value of the diagonal imbalance P in a specific point, time or speed, or the representative value of the diagonal imbalance P in a specific section or time to correct a zero point of the diagonal imbalance P can increase detection accuracy.

Further, the determiner 3 may determine that abnormality has occurred when an integral value of the diagonal imbalance P or the representative value at a certain mileage or elapsed time of the railway vehicle (that is, area of a region surrounded by the diagonal imbalance P or the representative value and the mileage or elapsed time, in a graph) becomes equal to or greater than a certain value. In this case, abnormality is determined in consideration of an amount of change in the diagonal imbalance P and a frequency at which the diagonal imbalance P exceeds the threshold value. Thus, detection accuracy is improved.

Also, the determiner 3 may determine that abnormality has occurred in the vehicle body support device when an amount of increase or decrease in the diagonal imbalance P at a certain mileage or elapsed time is greater than the positive threshold value or smaller than the negative threshold value. The threshold value herein may be increased or decreased in accordance with the mileage or elapsed time of the railway vehicle. Since the value of the diagonal imbalance P always tends to increase or decrease from a point at which abnormality has occurred in the vehicle body support device, it is possible to detect abnormality in the vehicle body support device by setting the threshold value in conformity with an increase or a decrease in the diagonal imbalance P in accordance with the mileage or elapsed time.

Further, the determiner 3 may determine that abnormality has occurred when an imbalanced state in which the diagonal imbalance P (including the "representative value of the diagonal imbalance P at a certain mileage or elapsed time") is greater than the positive threshold value or smaller than the negative threshold value continues for a certain mileage or elapsed time. In this case, the determiner 3 uses a positive or negative first threshold value with respect to the diagonal imbalance P and a positive second threshold value with respect to the mileage or elapsed time for determination.

In other words, the determiner 3 determines that abnormality has occurred when a continued mileage or duration of the imbalanced state exceeds the second threshold value. In this case, since abnormality is determined in consideration of the duration or continued mileage for which the diagonal imbalance P exceeds (or falls below) the first threshold value, detection accuracy is improved.

The second threshold value may be a function of the first threshold value. For example, the greater the first threshold value is, the smaller the second threshold value may be. This enables determination that abnormality has occurred even if the duration is short in a state in which there is a large amount of imbalance, while it is not determined that abnormality has occurred when the duration is short in a state in which there is a small amount of imbalance.

Figure 4:
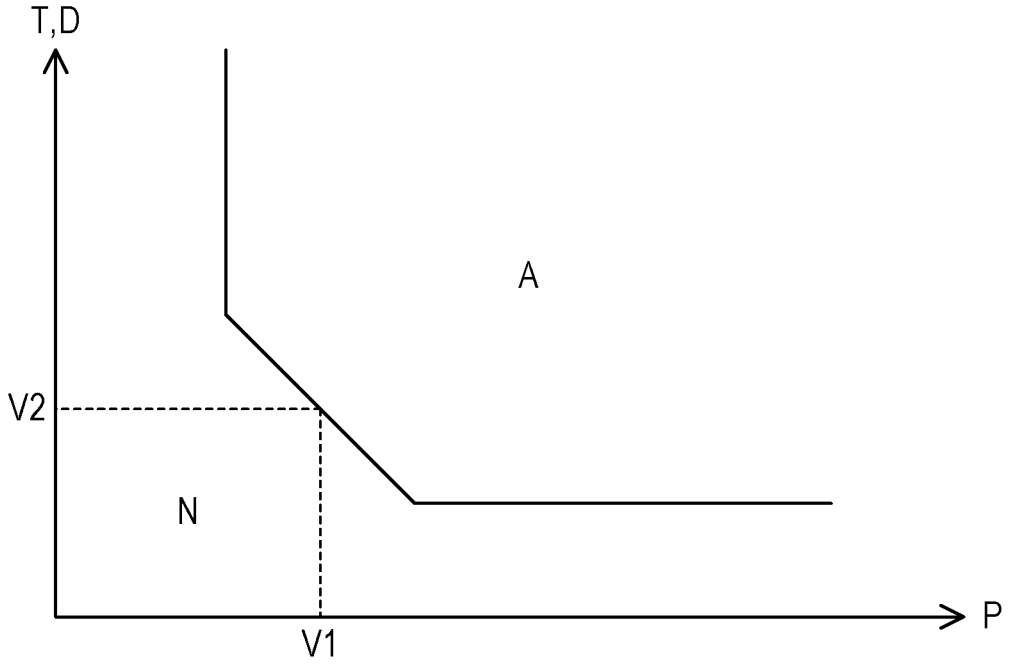
FIG. 4 is a schematic graph showing a relation between a first threshold value and a second threshold value.

As shown in FIG. 4, setting the second threshold value V2 to be a function of the first threshold value V1 can exclude a specified region from a region A determined to have abnormality, in an orthogonal coordinate system having the magnitude of the diagonal imbalance P as a first axis and the duration T or the continued mileage D as a second axis. In FIG. 4, N indicates a region determined to have no abnormality.

In each of the aforementioned determination methods, influence in line shape on the diagonal imbalance P due to a transition curve or a turnout has the same value at the same point. Therefore, by comparison with the diagonal imbalance P at the time of passing the same point in past, influence in line shape due to the transition curve or the turnout may be excluded to determine abnormality in the vehicle body support device.

In addition, the diagonal imbalance P fluctuates within a certain range even if there is no abnormality in the vehicle body support device. In case that there is no abnormality in the vehicle body support device, a value obtained by integrating the diagonal imbalance P by the mileage or elapsed time is always around zero. On the other hand, in case that abnormality in the vehicle body support device is irreversible, the value obtained by integrating the diagonal imbalance P by the mileage or elapsed time increases from the time when abnormality in the vehicle body support device has occurred. Therefore, integration of the diagonal imbalance P by the mileage or elapsed time enables determination of abnormality in the vehicle body support device accumulated from the point or time of zero reset.

The determiner 3 has a function to report a result of determination on abnormality in the vehicle body support device. Example methods of reporting includes causing a managing system inside and/or outside the railway vehicle to display warning or the like via an operation system of the railway vehicle to which the determiner 3 is coupled. As a result, failure in the vehicle body support device can be found at an early stage, and prompt response can be made.

[1-2. Effect]

According to the above-detailed embodiment, the following effect can be obtained.

(1a) Even if the absolute value of the diagonal imbalance P is small, it can be determined that abnormality has occurred when the value of the diagonal imbalance P is sustained while the railway vehicle is running. Therefore, abnormality that gradually progresses over a long time or long distance (for example, over a few hours) can be found at an early stage. Also, in case that the railway vehicle has stopped for a long time at a place where the absolute value of the diagonal imbalance P increases, erroneous determination that abnormality has occurred is avoided.

2. Second Embodiment

[2-1. Configuration]

The monitoring system 1 of a railway vehicle of the second embodiment is the same as the monitoring system 1 of the railway vehicle of the first embodiment, except for the calculation formula of the diagonal imbalance P used by the determiner 3.

In the second embodiment, the determiner 3 uses any one of formulae (3) to (8) below to calculate the diagonal imbalance P, instead of the aforementioned formula (1) or (2). The procedure to determine abnormality using the diagonal imbalance P by the determiner 3 is the same as that of the first embodiment.

$$P=A1-A2 \tag{3}$$

$$P=A3-A4 \tag{4}$$

$$P=A2+A3 \tag{5}$$

$$P=A1+A4 \tag{6}$$

$$P=A1-A3 \tag{7}$$

$$P=A2-A4 \tag{8}$$

The formulae (3) to (8) above correspond to the aforementioned formula (1) or (2) in which the pressures of any two air springs are set to zero. For example, the formula (3) corresponds to the formula (1) in which A3 and A4 are set to zero, and the formula (4) corresponds to the formula (2) in which A1 and A2 are set to zero.

In the second embodiment, the detector 2 may detect at least two pressures for use in calculation of the diagonal imbalance P, out of the pressure A1 of the first air spring 21, the pressure A2 of the second air spring 22, the pressure A3 of the third air spring 23, and the pressure A4 of the fourth air spring 24.

Therefore, the railroad truck 11 does not necessarily have to be provided with the air spring of which pressure is not to be measured. In other words, the monitoring system 1 of the second embodiment can monitor a railway vehicle having two or three air springs disposed on the railroad truck 11.

For example, with respect to a railway vehicle having only the first air spring 21 and the fourth air spring 24 attached to the railroad truck 11, abnormality can be determined by calculating the diagonal imbalance P by the aforementioned formula (6).

[2-2. Effect]

According to the above-detailed embodiment, the following effect can be obtained.

(2a) It is possible to find abnormality at an early stage that gradually progresses over a long time or long distance in a railway vehicle having less than four air springs attached to the railroad truck 11.

3. Third Embodiment

[3-1. Configuration]

The monitoring system 1 of a railway vehicle of the third embodiment is the same as the monitoring system 1 of the railway vehicle of the first embodiment, except for the calculation formula of the diagonal imbalance P used by the determiner 3.

In the third embodiment, the determiner 3 uses any one of formulae (9) to (12) below to calculate the diagonal imbalance P, instead of the aforementioned formula (1) or (2). The procedure to determine abnormality using the diagonal imbalance P by the determiner 3 is the same as that of the first embodiment.

$$P=A1 \quad (9)$$

$$P=A2 \quad (10)$$

$$P=A3 \quad (11)$$

$$P=A4 \quad (12)$$

The formulae (9) to (12) above correspond to the aforementioned formula (1) or (2) in which the pressures of any three air springs are set to zero. For example, the formula (9) corresponds to the formula (1) in which A2, A3 and A4 are set to zero.

In the third embodiment, the detector 2 may detect at least one pressure for use in calculation of the diagonal imbalance P, out of the pressure A1 of the first air spring 21, the pressure A2 of the second air spring 22, the pressure A3 of the third air spring 23, and the pressure A4 of the fourth air spring 24.

Therefore, the railroad truck 11 does not necessarily have to be provided with the air spring of which pressure is not to be measured. In other words, the monitoring system 1 of the third embodiment can monitor a railway vehicle having one air spring disposed on the railroad truck 11.

For example, as to a railway vehicle having only the first air spring 21 attached to the railroad truck 11, abnormality can be determined by calculating the diagonal imbalance P by the aforementioned formula (9).

[3-2. Effect]

According to the above-detailed embodiment, the following effect can be obtained.

(3a) It is possible to find abnormality at an early stage that gradually progresses over a long time or long distance in a railway vehicle having only one air spring attached to the railroad truck 11.

4. Other Embodiments

The embodiments of the present disclosure have been described above. However, the present disclosure is not limited to the above-described embodiments and can be modified variously.

(4a) A function achieved by one element in the aforementioned embodiment may be divided into two or more elements. A function achieved by two or more elements may be integrated into one element. Further, a part of the configuration of any of the aforementioned embodiments may be omitted. At least a part of the configuration of any of the aforementioned embodiment may be added to or replaced with the configuration of the aforementioned other embodiments. It should be noted that any and all modes that are encompassed in the technical ideas defined by the languages in the scope of the claims are embodiments of the present disclosure.

What is claimed is:

1. A monitoring system for a railway vehicle, comprising:

a detector that detects a pressure A1 of a first air spring, a pressure A2 of a second air spring, a pressure A3 of a third air spring, and a pressure A4 of a fourth air spring of the railway vehicle during running, the first air spring being disposed on a right front side in a running direction of the railway vehicle between a vehicle body and a railroad truck, the second air spring being disposed on a left front side in the running direction of the railway vehicle between the vehicle body and the railroad truck, the third air spring being disposed on a right rear side in the running direction of the railway vehicle between the vehicle body and the railroad truck, and the fourth air spring being disposed on a left rear side in the running direction of the railway vehicle between the vehicle body and the railroad truck; and a determiner that determines abnormality in a device that supports the vehicle body, based on the pressures detected by the detector, the determiner determining that abnormality has occurred when an integral value of a diagonal imbalance P obtained from a formula (1) or (2) below at a certain mileage or elapsed time of the railway vehicle is equal to or greater than a certain value:

$$P=(A1-A2)-(A3-A4) \quad (1)$$

$$P=(A3-A4)-(A1-A2) \quad (2).$$

2. The monitoring system for the railway vehicle according to claim 1, wherein the determiner further determines that abnormality has occurred when a representative value of the diagonal imbalance P at the certain mileage or elapsed time of the railway vehicle is greater than a positive threshold value or smaller than a negative threshold value.

3. The monitoring system for the railway vehicle according to claim 1, wherein the determiner further determines that abnormality has occurred when a state in which the diagonal imbalance P is greater than a positive threshold value or smaller than a negative threshold value has continued the certain mileage or elapsed time.

4. The monitoring system for the railway vehicle according to claim 1, wherein the determiner further determines that abnormality has occurred when an amount of increase or decrease in the diagonal imbalance P at the certain mileage or elapsed time is greater than a positive threshold value or smaller than a negative threshold value.

5. A monitoring system for a railway vehicle, comprising:

a detector that detects at least two of a pressure A1 of a first air spring, a pressure A2 of a second air spring, a pressure A3 of a third air spring, and a pressure A4 of a fourth air spring of the railway vehicle during running, the first air spring being disposed on a right front side in a running direction of the railway vehicle between a vehicle body and a railroad truck, the second air spring being disposed on a left front side in the running direction of the railway vehicle between the vehicle body and the railroad truck, the third air spring being disposed on a right rear side in the running direction of the railway vehicle between the vehicle body and the railroad truck, and the fourth air spring being disposed on a left rear side in the running direction of the railway vehicle between the vehicle body and the railroad truck; and a determiner that determines abnormality in a device that supports the vehicle body, based on the pressures detected by the detector, the determiner determining that abnormality has occurred when an integral value of a diagonal imbalance P obtained from an one of formulae (3) to (8) below at a certain mileage or elapsed time of the railway vehicle is equal to or greater than a certain value:

$$P=A1-A2 \quad (3)$$

$$P=A3-A4 \quad (4)$$

$$P=A2+A3 \quad (5)$$

$$P=A1+A4 \quad (6)$$

$$P=A1-A3 \quad (7)$$

$$P=A2-A4 \quad (8).$$

6. The monitoring system for the railway vehicle according to claim 5, wherein the determiner further determines that abnormality has occurred when a representative value of the diagonal imbalance P at the certain mileage or elapsed time of the railway vehicle is greater than a positive threshold value or smaller than a negative threshold value.

7. The monitoring system for the railway vehicle according to claim 5, wherein the determiner further determines that abnormality has occurred when a state in which the diagonal imbalance P is greater than a positive threshold value or smaller than a negative threshold value has continued at the certain mileage or elapsed time.

8. The monitoring system for the railway vehicle according to claim 5, wherein the determiner further determines that abnormality has occurred when an amount of increase or decrease in the diagonal imbalance P at the certain mileage or elapsed time is greater than a positive threshold value or smaller than a negative threshold value.

9. A monitoring system for a railway vehicle, comprising:

a detector that detects at least one of a pressure A1 of a first air spring, a pressure A2 of a second air spring, a pressure A3 of a third air spring, and a pressure A4 of a fourth air spring of the railway vehicle during running, the first air spring being disposed on a right front side in a running direction of the railway vehicle between a vehicle body and a railroad truck, the second air spring being disposed on a left front side in the running direction of the railway vehicle between the vehicle body and the railroad truck, the third air spring being disposed on a right rear side in the running direction of the railway vehicle between the vehicle body and the railroad truck, and the fourth air spring being disposed on a left rear side in the running direction of the railway vehicle between the vehicle body and the railroad truck; and a determiner that determines abnormality in a device that supports the vehicle body, based on the pressure detected by the detector, the determiner determining that abnormality has occurred when an integral value of a diagonal imbalance P obtained from an one of formulae (9) to (12) below at a certain mileage or elapsed time of the railway vehicle is equal to or greater than a certain value:

$$P=A1 \quad (9)$$

$$P=A2 \quad (10)$$

$$P=A3 \quad (11)$$

$$P=A4 \quad (12).$$

10. The monitoring system for the railway vehicle according to claim 9, wherein the determiner further determines that abnormality has occurred when a representative value of the diagonal imbalance P at the certain mileage or elapsed time of the railway vehicle is greater than a positive threshold value or smaller than a negative threshold value.

11. The monitoring system for the railway vehicle according to claim 9, wherein the determiner further determines that abnormality has occurred when a state in which the diagonal imbalance P is greater than a positive threshold value or smaller than a negative threshold value has continued at the certain mileage or elapsed time.

12. The monitoring system for the railway vehicle according to claim 9, wherein the determiner further determines that abnormality has occurred when an amount of increase or decrease in the diagonal imbalance P at the certain mileage or elapsed time is greater than a positive threshold value or smaller than a negative threshold value.

* * * * *